United States Patent [19]

Deutsch

[11] 4,323,241

[45] Apr. 6, 1982

[54] PINBALL GAME APPARATUS

[76] Inventor: Reinhard Deutsch, Gräfstrasse 47, 6000 Frankfurt am Main, Fed. Rep. of Germany

[21] Appl. No.: 178,288

[22] Filed: Jun. 15, 1980

[51] Int. Cl.[3] ..... A63F 7/00

[52] U.S. Cl. ..... 273/121 A; 273/DIG. 26

[58] Field of Search ..... 273/121 A, 119 A, 120 A, 273/122 A, 123 A, 124 A, 125 A, DIG. 26, 118 A, 109; 40/560, 427

[56] References Cited

U.S. PATENT DOCUMENTS 2,077,684 4/1937 Gensburg ..... 273/121 A 3,901,511 8/1975 Garbark ..... 273/119 A

OTHER PUBLICATIONS

"Popular Science", May 1979, p. 13.

*Primary Examiner*—George J. Marlo

*Attorney, Agent, or Firm*—Barlow & Barlow

[57] ABSTRACT

A pinball game apparatus is disclosed that has a housing in which a sloping playing surface is suitably supported. On the playing surface targets are provided and at least one is movable and coupled to an electric switch. If the player is successful in hitting the movable target, the switch actuated thereby turns on a film projector, which projects an image onto a matte pane screen located in the playing surface. A stepper motor is provided to control the projector so that each time the movable target is struck, a new image is projected upon the matte pane screen.

4 Claims, 3 Drawing Figures

PINBALL GAME APPARATUS

The invention relates to a pinball game apparatus with a housing, the upper side of which is designed as a game surface with targets for a playing ball, at least one target being movable and forming the actuating means of an actuating switch for an electrical system.

It is conventional practice in pinball game apparatus to modify in a minor way the structures on the game surface and also the optics, the design and the score value of individual targets from time to time in order to revivify the incentive of practiced players without thereby however changing the principle of the game. The score values and the design often are altered by the exchangeable nature of the housing surface or its prints. In this manner dislay lamps lit by the actuation belonging to the targets may show different values.

It is the object of the invention to create a pinball game apparatus wherein changes in score values and design are possible at little cost.

This problem is solved by the invention in that an opening sealed by a matte pane of an image reproduction means is provided in the game surface and together with an electrical system that includes an image advance motor for the image reproduction means.

In such a construction, the image pattern in the image reproduction means only need being changed from time to time in order to change the scores assigned to the targets by the images reproduced. In relation to the particular image pattern selected, the visual impression made by, and hence the design as well of the game surface is changed appreciably. Generally popular image themes may be chosen as the image pattern. This may well substantially increase the appeal of the game as the player will be anxious to reproduce a specific image theme personally preferred by him, by hitting the target releasing the image reproduction of the image advance and hence the reproduction of an ever new image by means of the playing ball.

Preferably the image reproduction means comprises a projector mounted in the housing, with the projection optics pointing at the image screen in the form of a matte pane or ground glass, which is separate from the projector. This makes it easier to exchange any damaged matte pane and to remove the top side from the housing without being required thereby to change the projector or to remove it from the housing, contrary to what is the case for an image reproducing means in which the optical part and the matte pane are present in their own common housing.

Even though the projector may be designed as a continual image projector, preferably it will be a still image projector as the latter is more economical for the purposes of a pinball game apparatus.

It is furthermore advantageous that the projector comprises a cassette with an endless film in it. In this manner the images reproduced with repeat cyclically without having to change or wind back the image pattern. Such a projector, too, is less sensitive to vibrations than for instance one for slides.

A preferred illustrative embodiment of the invention is described in greater detail below in relation to the drawing.

Figure 1:
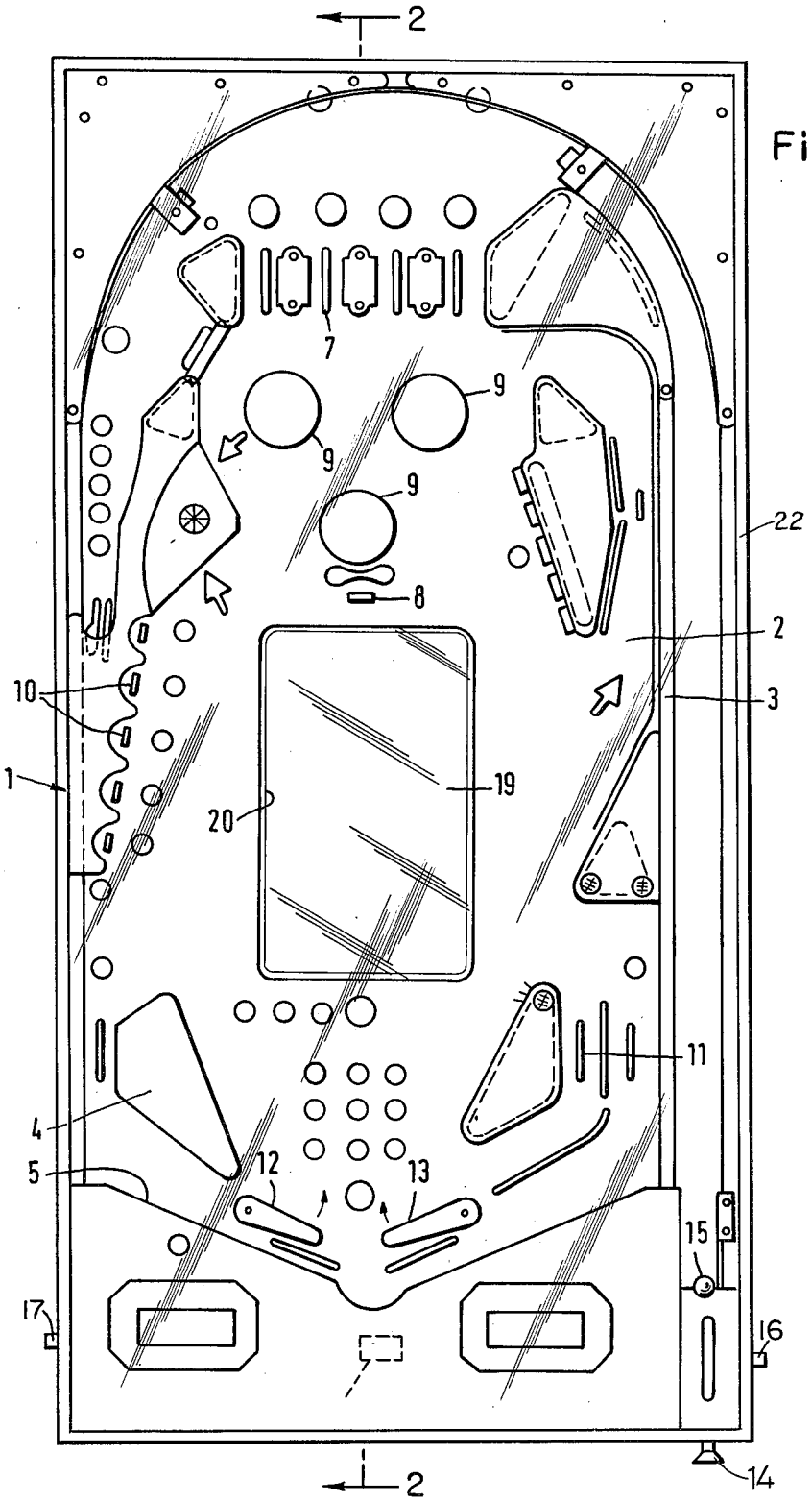
FIG. 1 is a top view of the game surface of the pinball game apparatus.
Figure 2:
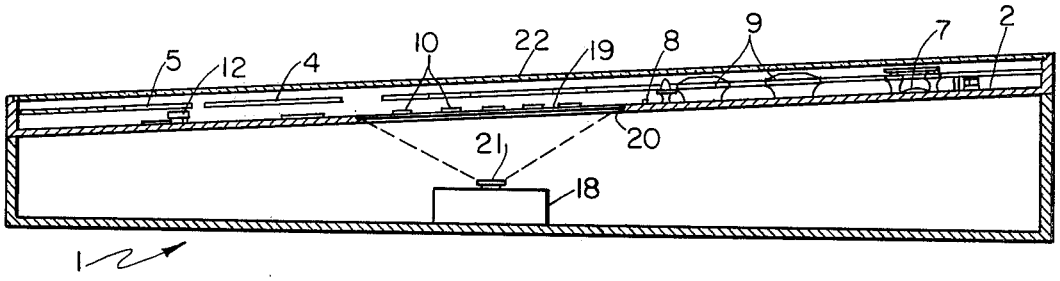
FIG. 2 is a reduced cross section taken on line 2—2 of FIG. 1.

The pinball game apparatus comprises a housing 1 of which the upper face 2 forms the game area that is conventionally covered by a transparent protecting glass pane 22 (FIG. 2). As is customary in apparatus of this nature, the game surface slopes somewhat toward the front narrow side of housing 1 and comprises conventional components such as guide walls, for instance guide walls 3, 4 and 5, the various fixed and elastic, active and passive targets, for instance targets 7, 8, 9, 10 and 11 and pivoting strike levers 12 and 13.

When contact is made with certain targets by a playing ball 15, which is thrust by an impact bar 14 through a guide channel on the right-hand side of the game area 2 into same, the winning numbers of a display board, omitted from the figure but high on the back side of the housing 1, will be reproduced automatically.

The thrust levers 12 and 13 are temporarily pivoted by manual actuation of the buttons 16 and 17 respectively into the directions of their associated arrows, whereby the playing ball 15 is thrown back onto the playing area where, due to the sloping of same and/or due to the recoil from a target, it approaches the thrust lever and threatens to roll through it into the "game-over" section.

In the housing 1, which has been illustrated with parts omitted for clarity, an image reproducing means with a projector 18 for still images and a separate or rear profection screen matte pane 19 as the image reproduction screen, these parts being integrated in said housing. The screen or matte pane 19 seals an opening 20 in the playing area 2, and the projection optics 21 of the projector 18 mounted to the housing bottom points toward the matte pane or back of the screen 19.

Figure 3:
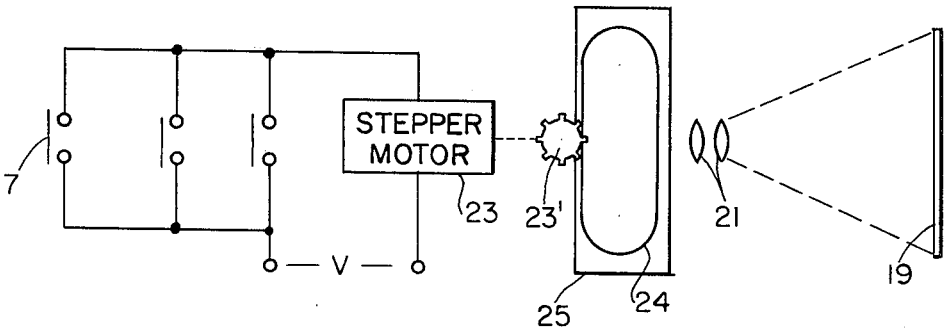
FIG. 3 is a diagramatic view of the projector control.

At least one predetermined target, for instance target 7, simultaneously will act as the activation member of an actuation switch for the image advance motor 23 of projector 18. For example, as seen in FIG. 3, the image advance motor may be a stepper motor driving a sprocket 23' of a continuous film 24. The projector is preferably arranged to reproduce an endless film, with a number of sequentially mounted pictures, located in a cassette 25 in the form of loose loops. Contrary to the case for the slide projectors, such a reproduction apparatus is especially rugged and shock-proof, and, contrary to the case for projectors with films other than endless, requires no rewinding of the film.

If the player therefore succeeds in hitting this predetermined target 7 for the first time with the playing ball, the projection bulb and the image advance motor of projector 18 are turned on and a first image is projected on the matte pane screen 19. A new image will be projected on the matte pane screen 19 whenever another hit is registered.

One or more other targets designed in the manner of target 7 and connected electrically in parallel with it also can trigger the image reproduction or the image change. There is furthermore the possibility to trigger the image reproduction or change only when two or more targets have been hit, whether in a predetermined or random sequence.

The projected images may represent popular patterns, the triggering of image reproduction or change corresponding to a predetermined point-value for scoring. At the same time, obtaining the reproduction of specific images desired by the particular player increases the suspense for him. Furthermore, the image patterns can be easily changed from time to time.

I claim:

1. A pinball game apparatus with a housing of which the upper face is designed as a playing area with targets for a playing ball, at least one movable target being provided, an electrical system, said target forming the actuation means of an actuation switch in said electrical system, the playing area having an opening sealed by a matte pane, an image reproducing means, said image reproducing means being within said housing and including means for projecting different images onto said matte pane and a change stepper motor, said motor being in said electrical system and being adapted to change the image projected, each step of said motor being actuated by said switch.

2. A game apparatus as in claim 1, wherein said image reproducing means comprises a projector mounted in the housing, the projection optics of said projector pointing at the matte pane which is separate from said projector.

3. A game apparatus as in claim 2, wherein the projector is a still-image projector.

4. A game apparatus as in claim 3, wherein the projector comprises a film-cassette with an endless film.

* * * * *